US005506669A

United States Patent [19]

Inoue et al.

[11] Patent Number: 5,506,669

[45] Date of Patent: Apr. 9, 1996

[54] CLEANING DEVICE HAVING POTENTIAL APPLYING MEMBER AND IMAGE FORMING APPARATUS HAVING A RECIPROCATING RECORDING MATERIAL CARRYING MEMBER

[75] Inventors: Masahiro Inoue, Yokohama; Takashi Fujita, Kawasaki; Nobuhiko Takekoshi, Tokyo, all of Japan

[73] Assignee: Canon Kabushiki Kaisha, Tokyo, Japan

[21] Appl. No.: 280,465

[22] Filed: Jul. 26, 1994

[30] Foreign Application Priority Data

Jul. 30, 1993 [JP] Japan ..... 5-208310

[51] Int. Cl.[6] ..... G03G 21/00

[52] U.S. Cl. ..... 355/296; 15/1.51; 355/300

[58] Field of Search ..... 355/296, 297, 355/299, 300, 301; 15/1.51

[56] References Cited

U.S. PATENT DOCUMENTS

| | | | |
|---|---|---|---|
| 3,510,903 | 5/1970 | Stoever et al. | 355/300 X |
| 3,879,785 | 4/1975 | Roth et al. | 355/297 |
| 4,530,595 | 7/1985 | Itaya et al. | 355/296 |
| 5,075,733 | 12/1991 | Weissberger et al. | 355/300 |
| 5,119,144 | 6/1992 | Hada et al. | 15/1.51 X |

FOREIGN PATENT DOCUMENTS

| | | | |
|---|---|---|---|
| 60-6977 | 1/1985 | Japan | 355/300 |

*Primary Examiner*—William J. Royer

*Attorney, Agent, or Firm*—Fitzpatrick, Cella, Harper & Scinto

[57] ABSTRACT

A cleaning device including a flexible member to be cleaned, a cleaning unit for cleaning a surface of the member to be cleaned, the cleaning unit including a cleaning web in contact with the member to be cleaned, and a potential applying member, provided on an opposite side of the member to be cleaned from the cleaning web, for applying a predetermined potential to the member to be cleaned. The potential applying member is provided at substantially the same position as the cleaning web in a direction of movement of the member to be cleaned.

42 Claims, 4 Drawing Sheets

CLEANING DEVICE HAVING POTENTIAL APPLYING MEMBER AND IMAGE FORMING APPARATUS HAVING A RECIPROCATING RECORDING MATERIAL CARRYING MEMBER

BACKGROUND OF THE INVENTION

1. Field of the Invention

The present invention relates to a cleaning device for cleaning a flexible member to be cleaned and an image forming apparatus comprising the same, and particularly to a cleaning device and an image forming apparatus comprising the same which can suitably be applied to, for example, an electrophotographic image forming apparatus, particularly a color electrophotographic copying apparatus in which a plurality of toner images having different colors are formed on a photosensitive drum such as an electrophotographic photosensitive member, and are successively transferred one over the other on the same recording material held on a recording material holding member as a member to be cleaned to obtain a color image.

2. Description of the Related Art

Various color image forming apparatuses have been previously proposed in which a plurality of image forming sections are provided for respectively forming toner images having different colors, and the toner images are successively transferred one over the other on the same recording material to obtain a color image. Of the image forming apparatuses, a multi-color electrophotographic color copying apparatus is popular.

An example of such a color electrophotographic copying apparatus is briefly described below with reference to FIG. 6. As illustrated in FIG. 6, a color electrophotographic copying apparatus has a conveyance belt 108 stretched between a pair of rollers 117*a* and 117*b* which travels in the direction of arrow B shown in the drawing by a driving source (not shown) in an apparatus body 110, and four image forming sections Pa, Pb, Pc and Pd are disposed above the conveyance belt 108. Since the four image forming sections have the same configuration, the configuration is schematically described below by taking the image forming section Pa, for the first color, as an example. (See for example, photosensitive drums 101*b* through 101*d* of image forming sections Pa through Pd, respectively, and transfer charge member 104*b* through 104*d* of image forming sections Pa through Pd).

In the image forming section Pa, a cylindrical photosensitive drum 101*a* is disposed which contacts the conveyance belt 108 to rotate in the direction of arrow A. After a photosensitive layer on the surface of the photosensitive drum 101*a* is uniformly charged by a primary charger 115*a*, a light image 116*a* having a yellow component of an original image is exposed on the photosensitive drum 101*a* to form an electrostatic latent image thereon. The latent image is moved to the position of a development device 103*a* by rotation of the photosensitive drum 101*a*, and is developed by the yellow toner supplied from the development device 103*a* at that position to be visualized as a yellow toner image.

The yellow toner image is moved to a transfer position where a transfer charge member 104*a* is disposed with rotation of the photosensitive drum 101*a*. In time with this movement, a recording material (not shown) is conveyed to the transfer position from a conveyance passage 112, and a transfer bias is applied to the transfer charge member 104*a* to transfer the yellow toner image onto the recording material from the photosensitive drum 101*a*.

The toner remaining on the photosensitive drum 101*a* is then removed by a cleaning device 105*a* to bring about a state for a next image forming process. On the other hand, the recording material to which the yellow toner image was transferred is moved to the image forming section Pb of a second color by being conveyed by the conveyance belt 108.

The image forming section Pb of the second color has the same structure as that of the image forming section Pa of the first color. A latent image is formed on the photosensitive drum, and then developed by a magenta toner, and the obtained magenta toner image is transferred onto the recording material so as to be superimposed on the yellow toner image by the transfer section. Similarly, in the image forming sections Pc and Pd, a cyan toner image and a black toner image are respectively formed and successively transferred onto the recording material so as to be superimposed to obtain a color image comprising the four color toner images superimposed on the recording material.

The recording material on which the four color toner image was transferred is separated from the conveyance belt 108, and is sent to a fixing device 107 provided with a pair of rollers including a fixing roller and a pressure roller. In the fixing device 107, the toner images are generally fixed by heating under pressure in a nip portion between the rollers which are heated to a predetermined temperature to mix the colors and fix the toner images to the recording material. The thus-formed full-color permanent image is discharged to the outside of the copying apparatus.

The color toners used are required to have the characteristics of good melting properties and color mixing properties for heating in the fixing device. This is because poor melting and color mixing properties cause the occurrence of many air gaps between toner particles, the loss of the intrinsic color tone of toner coloring matter due to the scattering of light on the boundaries between the toner particles and air, and deterioration in the color reproducibility due to hiding of a toner of a lower layer by the toner of the upper layer in the superimposed toner portion. A so-called sharp melting toner having a low softening point and a low melt viscosity is used as a toner satisfying the good melting and color mixing properties. The use of a sharp melting toner can produce a color copy faithful to an original with high color reproducibility.

However, since the sharp melting toner has high affinity, it has the drawback that the unfixed toner image is easily offset to the fixing roller on the side of the recording material where the unfixed toner image is held in the fixing device. In the fixing device, both heating and pressing are performed, and the toner having high affinity is thus liable to be transferred to the fixing roller and adhere thereto by the heating and pressing. The adhesion of the toner to the fixing roller causes the transfer of the toner to a next recording material or fixing of the toner on the fixing roller, thereby causing a poor image.

In order to prevent the occurrence of such a poor image, a release agent is applied to the fixing roller, e.g., a liquid release agent, such as oil or the like, is coated on the fixing roller before the toner image on the recording material is fixed by the fixing device. This brings the fixing roller into contact with the toner image on the recording material through the release agent, not direct contact therewith, in heating and pressing the toner image, and thus effectively prevents the transfer and adhesion of the toner to the fixing roller side.

After fixing the toner image, the release agent remaining on the fixing roller is wiped off by a cleaning device provided with, for example, nonwoven fabric.

On the other hand, after the recording material has been separated from the conveyance belt 108, the charge of the conveyance belt 108 which was applied during transfer is removed by the operation of an inner destaticizer 113 and an outer destaticizer 114, both of which are potential applying members. The conveyance belt 108 is then cleaned by a fur brush 111 and a backup brush 120 of conveyance belt cleaning means which is provided on the downstream side of the destaticizers 113 and 114 in the direction of movement of the conveyance belt 108 so as to remove dust, such as the fogging toner, scattered toner or paper powder which adheres to the surface of the conveyance belt 108.

The toner and dust scraped off by the fur brush 111 are recovered by suction by a suction member 111*a*.

The conveyance belt 108 is generally formed by processing a plastic resin film in an endless belt. The conveyance belt 108 has high resistance because of the characteristics of the plastic resin and the guarantee of adhesion of the recording material to the conveyance belt. In the case of multiple transfer in which a plurality of toner images having different colors are transferred to be superimposed on the recording material, the so-called charge-up phenomenon of the conveyance belt thus occurs, and frequently has adverse effects on the transfer of the toner images to the recording material. In order to decrease the charge-up phenomenon during multiple transfer, a method is thus employed in which the conveyance belt is charged with electricity of a polarity opposite to that of the transfer polarity in destaticization of the conveyance belt 108.

As described above, the application of the release agent to the fixing roller in the fixing device 107 prevents the transfer of toner to the fixing roller from the toner image to be fixed to the recording material. However, in the case of copying on both sides of the recording material, there is the new problem that the release agent which adheres to the recording material from the fixing roller is transferred to the conveyance belt and further transferred to the photosensitive drum from the conveyance belt, thereby causing a poorly formed image.

Namely, in both-side copying, if it is assumed that the side of the recording material on which an image is first formed is a first side, and the side on which an image is then formed is a second side, the release agent is transferred to the first side of the recording material by the first image formation. The transfer of the release agent causes no difficulty in one-side copying in which no image is formed on the second side. However, in both-side copying, since the recording material is attached to and supported by the conveyance belt with the first side in contact therewith, the release agent on the first side is transferred to the surface of the conveyance belt. When the recording material is then separated from the conveyance belt after the toner image is transferred to the second side, the release agent on the surface of the conveyance belt is transferred and adheres to the surface of the photosensitive drum in contact with the conveyance belt.

When the release agent is transferred and adheres to the photosensitive drum, as described above, the release agent cannot be sufficiently removed by a photosensitive drum cleaning device for removing the toner remaining on the photosensitive drum. The toner remaining on the photosensitive drum is placed on the release agent, such as oil or the like, thereby deteriorating the release of the remaining toner from the photosensitive drum and thus causing insufficient removal of the remaining toner by the cleaning device. If the release agent adheres to the photosensitive drum, the toner other than the remaining toner is liable to adhere to portions other than the image formation region during development (particularly, jumping development in which the toner is scattered significantly produces adhesion of excess toner).

In this way, the remaining toner and the toner used in development adhere to a portion on the photosensitive drum to which the toner must not adhere, due to the release agent on the photosensitive drum, and are transferred in subsequent image formation, resulting in the formation of a stained copy image.

In order to prevent the above problems, the release agent which adheres to the surface of the conveyance belt 108 may be cleaned off by the cleaning means such as the fur brush 111. However, conventional cleaning means can hardly remove the release agent.

The conventional cleaning means also causes the problem that since the conveyance belt is destaticized for obtaining the sufficient toner cleaning properties before cleaning so that the adhesion between the conveyance belt and the toner adhering to the surface thereof is decreased, the toner having the adhesion which is decreased by destaticization falls from the conveyance belt and brings about contamination of the outer destaticizer 114 positioned below the conveyance belt.

In relation to the above problems, Japanese Patent Laid-Open No. 2-39186 discloses a fur brush which is made of a conductive material so that sufficient cleaning properties can be obtained by applying a bias thereto even if the conveyance belt is previously destaticized. However, this also cannot remove the release agent which adheres to the conveyance belt.

In addition, since the conveyance belt 108 is not restricted in the portion of the destaticizers 113 and 114, the distance between the conveyance belt and the destaticizers is partially changed due to vertical vibration of the conveyance belt 108. When the conveyance belt is destaticized or charged with electricity of a polarity opposite to that of the transfer charge for ensuring good multiple transfer, nonuniformity occurs in destaticization and reverse charge, thereby causing the problem of producing a poor image due to partial, poor cleaning and poor transfer.

SUMMARY OF THE INVENTION

An object of the present invention is to provide a cleaning device and an image forming apparatus comprising the cleaning device which sufficiently cleans a flexible member to be cleaned, such as a belt.

Another object of the present invention is to provide a cleaning device and an image forming apparatus comprising the cleaning device which prevents a potential applying member from being stained by a toner due to the toner falling from a member to be cleaned.

A further object of the present invention is to provide a cleaning device and an image forming apparatus comprising the cleaning device which prevents partial nonuniformity in potential of a member to be cleaned caused by the change in the distance between a potential applying member and the member to be cleaned due to vibration of the member to be cleaned.

Further objects and characteristics of the present invention will be made clear from the detailed description of the invention with reference to the attached drawings.

DETAILED DESCRIPTION OF THE PREFERRED EMBODIMENTS

An image forming apparatus in accordance with an embodiment of the present invention is described below with reference to FIG. 1.

Figure 1:
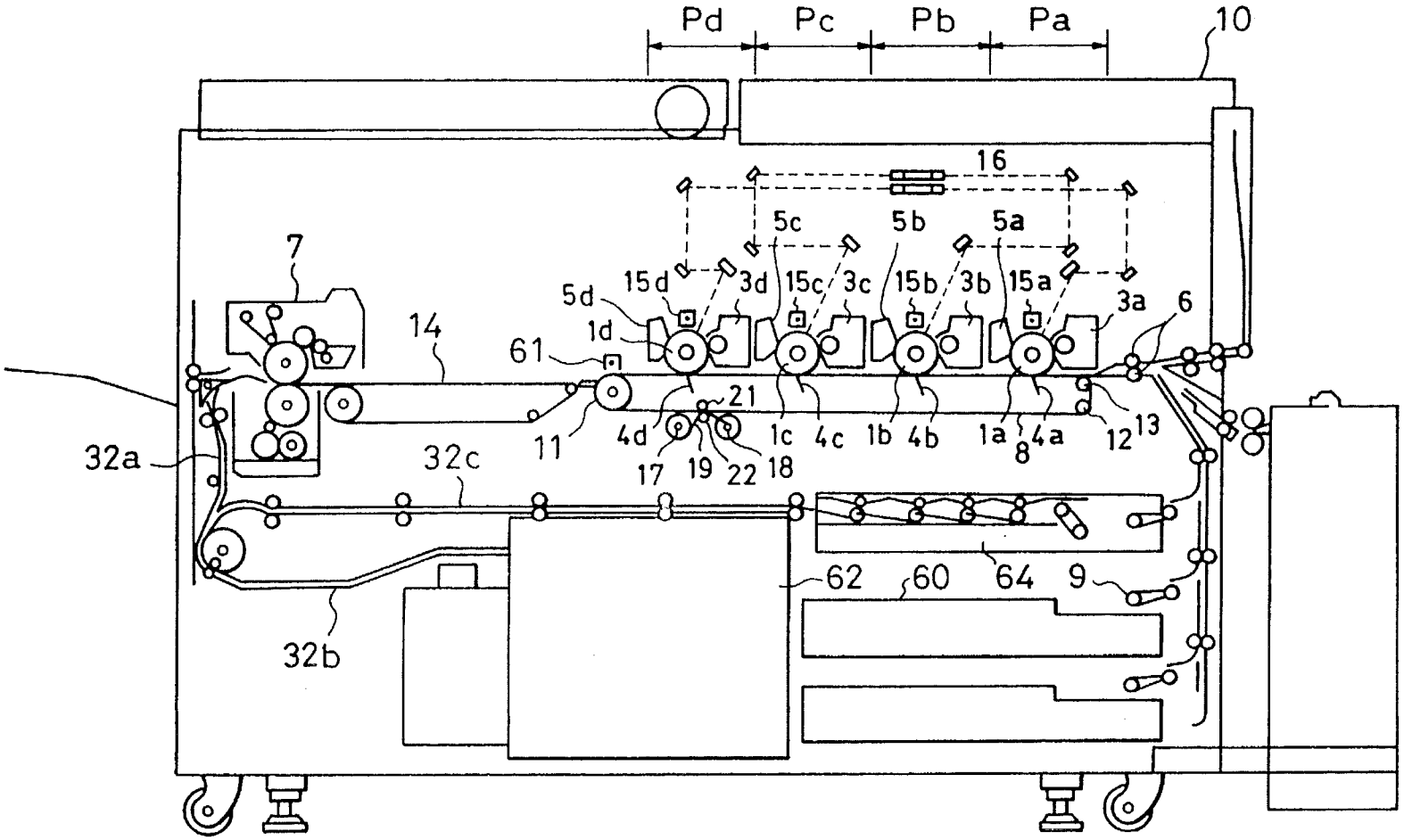
FIG. 1 is a drawing illustrating the whole construction of an image forming apparatus in accordance with an embodiment of the present invention.

As illustrated in FIG. 1, this embodiment relates to a color electrophotographic copying apparatus.

In an image forming apparatus of this embodiment, image forming sections Pa, Pb, Pc and Pd are disposed in an apparatus body 10, and recording material conveying means comprising a conveyance belt 8 which is stretched between a driving roller 11 and driven rollers 12 and 13 is provided below the image forming sections Pa to Pd, the conveyance belt 8 being rotated at a speed of 100 mm/sec. in the direction of an arrow. In this embodiment, an endless sheet made of a polycarbonate resin film is used as the conveyance belt 8.

More preferred materials, other than the above material which can be used as a material for the conveyance belt 8, are a polycarbonate resin modified with silicone resin, and polycarbonate resin in which conductive particles of carbon or the like are dispersed for decreasing the resistance to, for example, $10^{12}$ to $10^{15}$ Ω.cm. Polyurethane resins, polyester resins, nylon resins and polyvinylidene fluoride (PVdF) resins can also be used.

In this embodiment, the conveyance belt 8 is formed in a thickness of 150 μm and a width of 334 mm. An oscillation mechanism for driving the conveyance belt 8 at the substantially widthwise centers of the driving roller 11 and the driven rollers 12 and 13 in rotation is provided for preventing the conveyance belt 8 from slipping off the rollers 11, 12 and 13 due to the widthwise shift of the conveyance belt 8 at right angles to the movement direction.

Register roller 13 is disposed on the right side of the conveyance belt 8 in FIG. 1. The image forming sections Pa, Pb, Pc and Pd which are provided above the conveyance belt 8 have photosensitive drums 1*a*, 1*b*, 1*c* and 1*d*, respectively. Chargers 15*a*, 15*b*, 15*c* and 15*d* are provided above the photosensitive drums 1*a*, 1*b*, 1*c* and 1*d*, and development devices 3*a*, 3*b*, 3*c* and 3*d* are provided on the right sides of the photosensitive drums 1*a*, 1*b*, 1*c* and 1*d*, respectively.

A common laser beam scanner 16 is disposed above the photosensitive drums 1*a*, 1*b*, 1*c* and 1*d*. The laser beam scanner 16 comprises a semiconductor laser, a polygon mirror, a fθ lens and so on. When receiving an electric digital image signal, the laser beam scanner 16 scans the photosensitive drums 1*a*, 1*b*, 1*c* and 1*d* with a laser beam modulated corresponding to the signal in the bus direction thereof between the chargers 15*a*, 15*b*, 15*c* and 15*d* and the development devices 3*a*, 3*b*, 3*c* and 3*d*, to expose the photosensitive drums 1*a* to 1*d*.

When an image formation start signal is input to the image forming apparatus, the photosensitive drum 1*a* starts to rotate in the direction of an arrow, is uniformly charged by the charger 15*a*, and then is exposed by the laser beam which is emitted from the laser beam scanner 16 and modulated by an image signal corresponding to a yellow component of an original image to form a latent image of the yellow component on the photosensitive drum 1*a*. The latent image is developed by the yellow toner supplied from the development device 3*a* to be visualized as a yellow toner image on the photosensitive drum 1*a*.

On the other hand, a recording material (paper) is discharged from a recording material cassette 60 by a pickup roller 9 and then sent to the register rollers 6. After the recording material is once stopped by the register rollers 6, the recording material is sent to the conveyance belt 8 which has already been started to rotate from the register rollers 6 in timing with the yellow toner image formed on the photosensitive drum 1*a*. The recording material supplied onto the conveyance belt 8 is charged for transfer by a charge member 4*a* from the rear side of the conveyance belt 8 to transfer the yellow toner image on the photosensitive drum 1*a* to the recording material in a transfer section having the transfer charge member 4*a* of the image forming section Pa.

The same image forming process is repeated for magenta, cyan and black in the image forming sections Pb, Pc and Pd, respectively, to obtain a color image by transferring toner images to superimpose the yellow toner image, a magenta toner image, a cyan toner image and a black toner image on the recording material in that order from the bottom.

After the transfer of the toner images is completed, the recording material is separated from the conveyance belt 8 while being subjected to AC destaticization by a separation charger 61 directly above the roller 11 at the left end of the conveyance belt 8, and then is sent to the fixing device 7 through a pre-fixing conveyance section 14. In the fixing device 7, the toner images are fixed by heating and pressing by a pair of rollers to mix the colors of the toner images and fix the images to the recording material to form a full-color permanent image.

After completion of the transfer, the toners remaining on the photosensitive drums 1*a*, 1*b*, 1*c* and 1*d* are removed by the cleaning devices 5*a*, 5*b*, 5*c* and 5*d*, respectively, for the subsequent next image formation.

In a one-side copy mode, after fixing of the toner images is completed, image formation is terminated, and the recording material is discharged to the outside of the body of the copying machine 10. While in a both-side copy mode, the recording material is reversed and is again sent to the conveyance belt 8 for forming again an image on the remaining side (second side) opposite to the side (first side) on which image formation is completed. The operator can select the one-side copy mode or both-side copy mode by an operation section on the front side of the apparatus.

During image formation on the second side, the recording material is passed through guides 32*a* and 32*b* of resending means and is once contained in a stocker 62. The recording material is then passed through the guide 32*b* from the stocker 62 in the opposite direction, and the upside-down recording material enters a guide 32*c* with the trailing end at the head end, and then enters a stand-by cassette 64. The recording material is then supplied onto the conveyance belt 8 through the register rollers 6, for forming an image on the second side thereof by the same method as that for the first side. After a color image is formed on the second side, the recording material is separated from the conveyance belt 8, sent to the fixing device 7 for fixing the image and then discharged as a both-side copy to the outside of the copying apparatus body 10.

Embodiment 1

Figure 2:
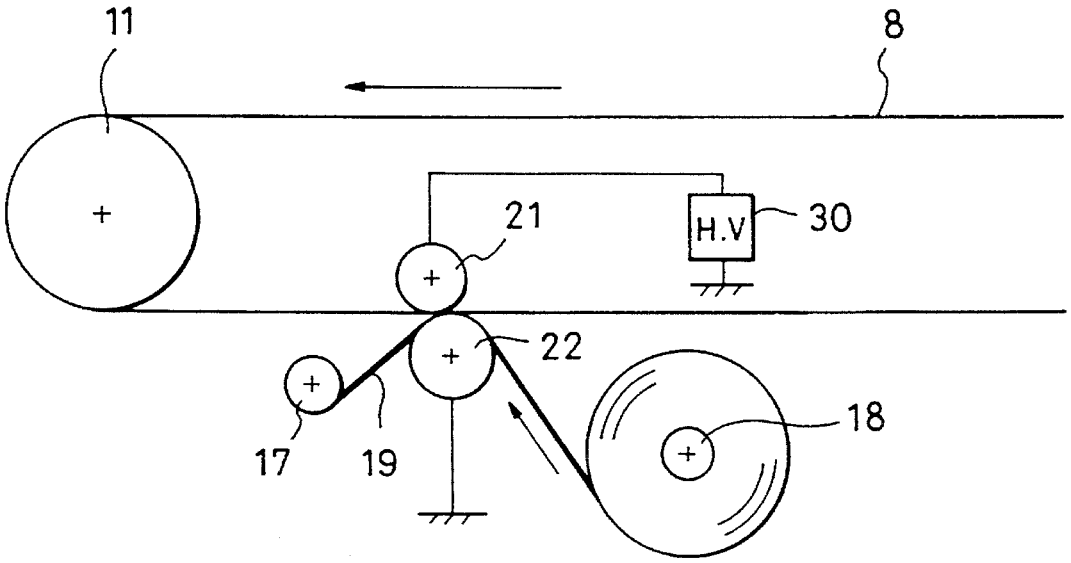
FIG. 2 is a sectional view illustrating a conveyance belt cleaning section provided in the image forming apparatus shown in FIG. 1.

In this embodiment, as illustrated in FIG. 2, a pair of rollers 17 and 18 are disposed at a downstream end of the conveyance belt 8, and a cleaning web 19 of a nonwoven fabric is wound on the roller 18 so as to be taken out by the roller 17. A pressure roller 22 for pressing the cleaning web 19 on the surface of the conveyance belt 8 is disposed between the rollers 17 and 18, and a destaticization roller (inner destaticization roller) 21 for the conveyance belt 8 is disposed on the rear side (inside) of the conveyance belt 8 so as to also serve as a backup of pressure of the cleaning web 19 on the conveyance belt 8. The position of contact between the destaticization roller 21 and the belt 8 is on the upstream side of the position of contact between the web 19 and the belt 8 in the movement direction of the belt 8.

At least the surface (cleaning surface) of the cleaning web 19 which contacts the conveyance belt 8 comprises fibers having a size of 10 μm or less at a rate of 70% or more, an average size of 10 μm or less, and a density of 0.05 to 0.80 g/cm$^3$, preferably 0.10 to 0.50 g/cm$^3$. The average distance between the respective fibers which form the cleaning web 19 is preferably smaller than the average size of the toner particles used for forming an image.

Preferred examples of fibers of the cleaning web 19 include fibers of polypropylene, rayon, acryl, nylon, polyester and vinylon, and mixtures of these fibers.

The pressure roller 22 comprises a rubber roller having a non-expandable or expandable conductive rubber layer which is formed on a core bar such as SUS which has a resistance value adjusted to about $10^5$ Ω or less by dispersing conductive particles therein. The pressure roller 22 is earthed.

The inner destaticization roller 21 comprises a rubber roller having a conductive rubber roller similar to that of the pressure roller 22, which is formed on a core bar such as SUS and which has a resistance value adjusted to about 108 Ω. A DC bias of polarity opposite to that of the transfer charge members 4*a* to 4*d* can be applied to the inner destaticizing roller 21 from a high-voltage power source 30 connected thereto. The bias is applied to the destaticizing roller 21 at the same time as the start of rotation of the conveyance belt 8 so as to be constantly applied to the destaticizing roller 21 during rotation of the conveyance belt 8.

The destaticization roller 21 is preferably arranged so as not to contact the cleaning web 19 and the pressure roller 22 even if the conveyance belt 8 oscillates. In this embodiment, since the conveyance belt 8 has a width of 334 mm and an oscillation width of 8 mm, the maximum length of the pressure roller 22 in the widthwise direction (thrust direction) at right angles to the movement direction of the belt 8 is 318 mm (334–8×2 mm). On the other hand, since the destaticization roller 21 must have a width greater than the maximum size of the recording material used for exhibiting the sufficient effect of destaticizing the recording material, the minimum width is about 300 mm. In this embodiment, the width of the destaticization roller 21 is thus 310 mm.

Since it is necessary for cleaning that the cleaning web 19 contact the entire portion of the conveyance belt 8 in the widthwise direction thereof, the width of the web is about 350 mm or more (334+8×2 mm). In this embodiment, the width is 352 mm in view of a margin.

Since the pressure roller 22 must uniformly press the cleaning web 19, the pressure roller 22 must be wider than the cleaning web 19. In this embodiment, the width of the pressure roller 22 is 360 mm.

Further, the cleaning web 19 is preferably used in a state wherein the surface thereof is renewed at appropriate intervals, for example, a state wherein the web 19 is taken up in a predetermined amount for a predetermined number of sheets on which images are formed. In this embodiment, the cleaning web 19 is wound on the roller 17 by means (not shown) in an amount of 5 mm for each 100 sheets on which images are formed.

In the image forming apparatus of this embodiment configured as described above, since the conveyance belt 8 is cleaned by using the cleaning web 19 made of a nonwoven fabric, the cleaning properties are improved, and not only the toner which adheres to the conveyance belt 8 but also the release agent which adheres thereto during image formation on both sides can efficiently be removed. It is thus possible to prevent re-adhesion of the release agent to the photosensitive drums 1*a* to 1*d* from the conveyance belt 8, thereby preventing a poor image stained by the release agent.

Since the inner destaticization roller 21 comprising a conductive rubber roller is provided for the conveyance belt 8, without the outer destaticizer, even if the conveyance belt 8 is destaticized before cleaning, there is no problem of staining the outer destaticizer by the toner due to falling of the toner from the conveyance belt 8. This prevents cleaning failure and transfer failure from occurring due to the partial poor destaticization of the conveyance belt 8 caused by the stain of the outer destaticizer, thereby preventing a poor image.

In this embodiment, since the cleaning web 19 supported by the pressure roller 22 is at a position corresponding to the outer destaticizer, and is refreshed at predetermined time intervals, the inner destaticizing roller 21 can sufficiently destaticize the conveyance belt 8.

Further, when the conveyance belt 8 is destaticized and charged with electricity of polarity opposite to the transfer polarity for securing good multiple transfer, since the conveyance belt 8 is held between the inner destaticization roller 21 and the pressure roller 22, the distance between the conveyance belt 8 and the destaticizer 21 is not changed due to vertical vibration of the conveyance belt 8, and the conveyance belt 8 can sufficiently be destaticized and charged with electricity of the opposite polarity. It is thus possible to prevent partial cleaning failure and transfer failure, and to prevent the poor image caused by such failures.

In formation of a four-color image, the potential on the inside of the conveyance belt 8 gradually increases with transfer, and the voltage applied to the transfer charge member 4*d* becomes high at the time of transfer of the fourth color image. The potential inside the belt 8 preferably has polarity opposite to the polarity of the potential applied to the inside of the belt 8 by the transfer charge member.

This embodiment can thus form and obtain a good high-quality image.

In this embodiment, although the bias applied to the inner destaticization roller 21 is controlled with a constant voltage, constant-current control also produces the same effects as those described above. It is preferable to apply a voltage comprising a DC voltage and an AC voltage superimposed.

In addition, a bias voltage with polarity opposite to the polarity of the voltage applied to the inner destaticization roller 21 may be applied to the pressure roller, or the inner destaticization roller 21 may be earthed without application of a bias thereto. Alternatively, a bias may be applied to both the inner destaticizing roller 21 and the pressure roller 22. Namely, a DC or AC voltage or a voltage comprising superimposed DC and AC voltages is applied to at least one of the destaticization roller 21 and the pressure roller 22.

Although the inner destaticization roller 21 is used as inner destaticization means, the form of the inner destaticization means is not limited to the roller, and it may be a blade form or a brush form having conductive fibers planted therein.

Embodiment 2

Figure 3:
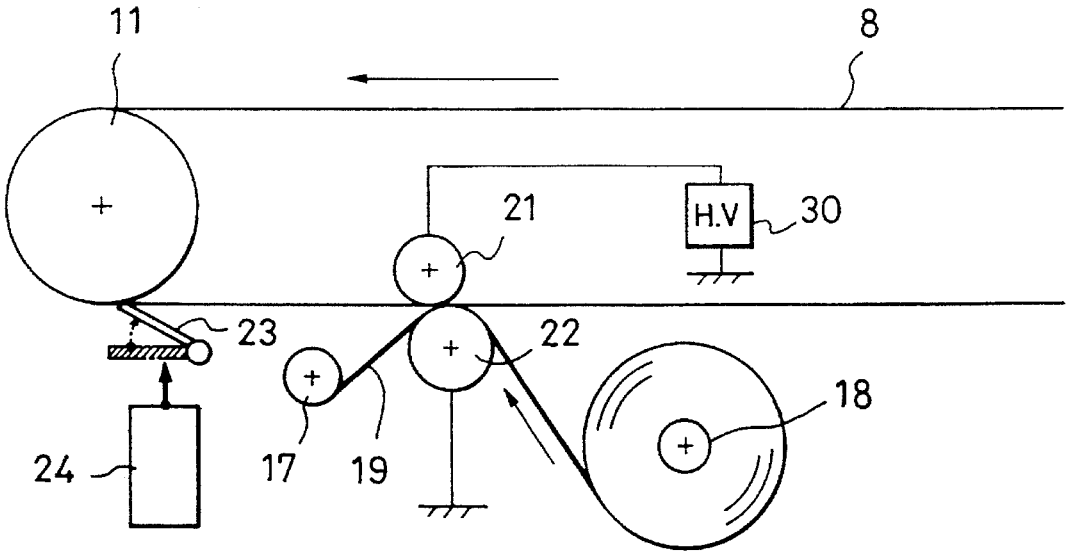
FIG. 3 is a sectional view illustrating a conveyance belt cleaning section in an image forming apparatus in accordance with another embodiment of the present invention.

FIG. 3 is a sectional view illustrating a conveyance belt cleaning section of an image forming apparatus in accordance with another embodiment of the present invention. This embodiment is characterized in that besides the cleaning web 19, a cleaning blade 23 is further provided as means for cleaning the conveyance belt 8 below the driving roller 11. The other members are the same as those shown in FIG. 1.

The cleaning blade 23 comprises polyurethane rubber having a hardness of about 65 degrees based on the JIS-A rubber hardness. The contact angle between the blade 23 and the conveyance belt 8 is adjusted to about 20°, and the penetration amount is adjusted to 1.5 to 2.0 mm. The cleaning blade is provided with a separation/approach mechanism comprising a solenoid 24 so that the blade 23 can separate from and approach the conveyance belt 8.

The cleaning operation of this embodiment is described below. In normal image formation, the surface of the conveyance belt 8 is cleaned only by the cleaning web 19, as in Embodiment 1, and the cleaning blade 23 is at a distance from the conveyance belt 8.

When jamming of the recording material occurs in the body of the image forming apparatus, and possibly causes adhesion of a large amount of toner to the conveyance belt 8, the jammed recording material is removed from the apparatus body, and the return operation of the apparatus body is started. At the same time as start of rotation of the conveyance belt 8 after the return operation is started, the solenoid 24 is operated to bring the cleaning blade 23 into contact with the conveyance belt 8. The contact state is maintained during at least one rotation of the conveyance belt 8 so that a large amount of toner which adheres to the conveyance belt 8 is cleaned off by the blade 23. After completion of cleaning, the solenoid 24 is again started to separate the cleaning blade 23 from the conveyance belt 8.

When a large amount of toner adheres to the conveyance belt 8 due to the occurrence of jamming or the like, the toner cannot be completely cleaned off by the cleaning web 19 during one rotation of the conveyance belt 8, or the feed interval of the web 19 must be decreased due to the adhesion of a large amount of toner even if the conveyance belt 8 can be cleaned, thereby causing the problem of significantly decreasing the life of the web 19. However, this embodiment can solve the above problems because the cleaning blade 23 is used.

Although, in this embodiment, the conveyance belt 8 is cleaned by the cleaning blade 23 when jamming occurs, the cleaning blade 23 can be used when a toner image for image density control or registration control is formed by directly transferring it onto the conveyance belt. In this case, good results similar to those described above can be obtained.

Embodiment 3

Figure 4:
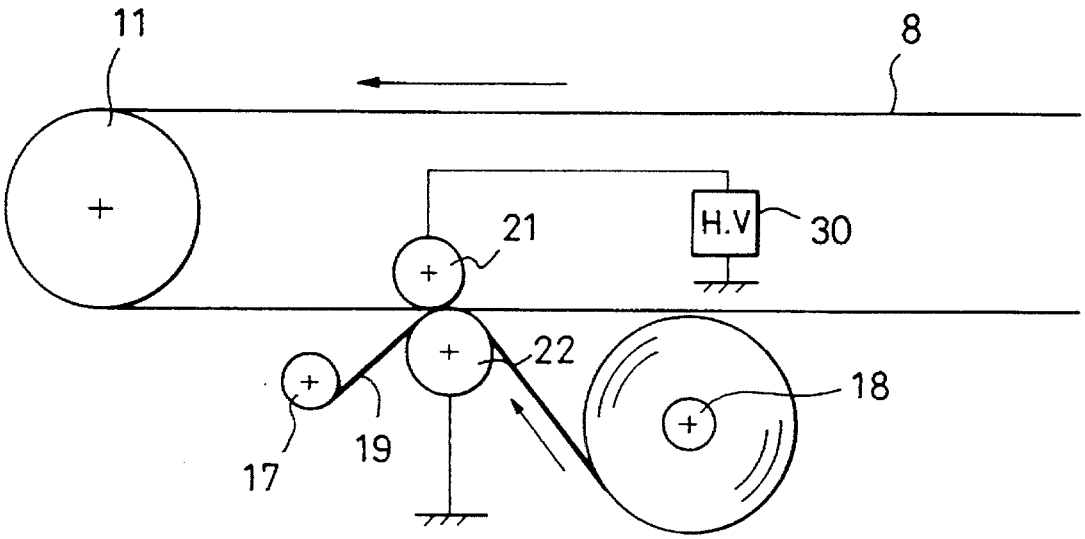
FIG. 4 is a sectional view illustrating a conveyance belt cleaning section in an image forming apparatus in accordance with a further embodiment of the present invention.

FIG. 4 is a sectional view illustrating a conveyance belt cleaning section of an image forming apparatus in accordance with a further embodiment of the present invention. This embodiment is characterized in that the cleaning web 19 has the cleaning surface shown in Embodiment 1 on both sides thereof, and a mechanism (not shown) for pressing toward the conveyance belt 8 is provided on the roller 18 so that the web 19 wound on the roller 18 can contact the conveyance belt 8.

In this embodiment configured as described above, when the conveyance belt 8 to which the release agent adheres during image formation on both sides is cleaned, the conveyance belt 8 is first cleaned by the surface of the cleaning web 19 on the upstream side for sufficiently removing the fogging toner and so on on the conveyance belt 8. On the downstream side, only the release agent on the conveyance belt 8 may be cleaned off by the back of the cleaning web 19, and the release agent can thus be sufficiently removed.

Although, in this embodiment, the surface and back of the cleaning web 19 comprising a single material are used, the cleaning web may be formed by a method of laminating a surface material having good cleaning properties for the toner and a back material having good cleaning properties for the release agent. In this case, more favorable effects can be obtained.

Figure 5:
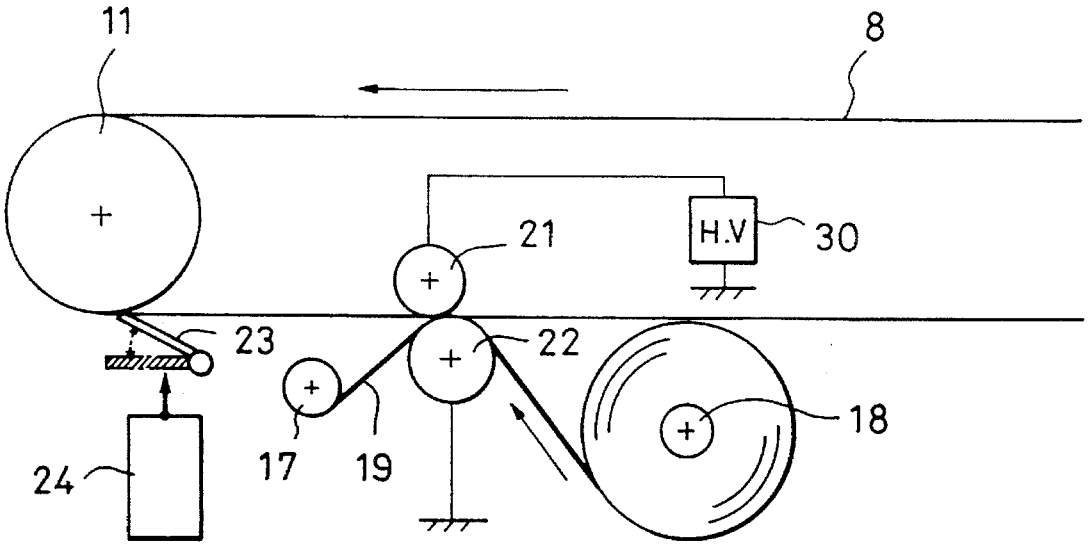
FIG. 5 is a sectional view illustrating the state in which a cleaning blade is provided in the cleaning section of the image forming apparatus shown in FIG. 4, as in the cleaning section shown in FIG. 3.
Figure 6:
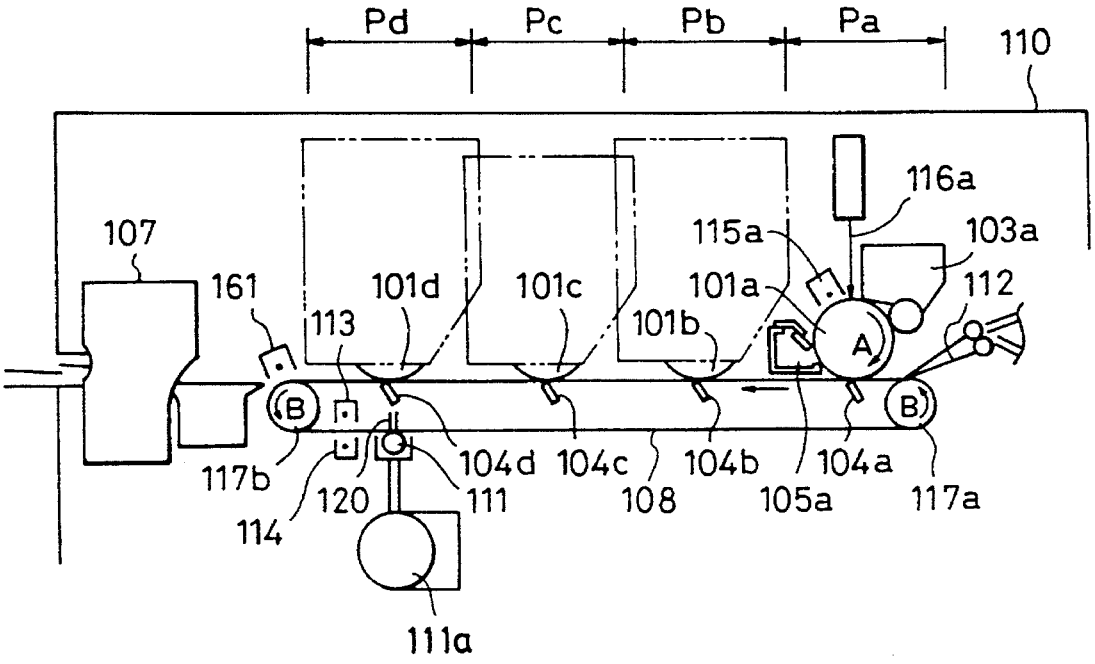
FIG. 6 PRIOR ART
FIG. 6 is a drawing illustrating the whole construction of a conventional image forming apparatus.

In this embodiment, the cleaning blade 23 can be used in combination with the cleaning web 19 as in Embodiment 2, as shown in FIG. 5, in order to further improve the cleaning effect.

As described above, in the cleaning section, the web used as means for cleaning the recording material conveyance belt is pressed on the surface of the conveyance belt by the pressure member, and the inner destaticizer also serving as a backup member is applied to the back of the conveyance belt so that the surface of the conveyance belt is cleaned by the web, and at the same time, a destaticization bias is applied to one or both of the pressure member and the inner destaticizer, thereby improving the cleaning effect of the cleaning means. In addition, since no outer destaticizer is provided below the conveyance belt, there is not a problem of staining the outer destaticizer by the toner due to toner falling from the conveyance belt before cleaning. It is thus possible to prevent the conveyance belt from being partly insufficiently destaticized. Further, because there is no change in the distance between the conveyance belt and the inner destaticizer due to vibration of the conveyance belt, it is possible to prevent the conveyance belt from being insufficiently destaticized due to the change in the distance. Not only the toner which adheres to the conveyance belt but also the release agent which adheres to the conveyance belt during image formation on both sides can thus be sufficiently removed, thereby obtaining a high-quality image by good image formation. The present invention is not limited to the above embodiments, and any variation can be made within the scope of the technical idea of the present invention.

What is claimed is:

1. A cleaning device comprising:

a flexible member to be cleaned;

cleaning means for cleaning a surface of said member to be cleaned, said cleaning means including a cleaning member in contact with said member to be cleaned; and a potential applying member for applying a predetermined potential to said member to be cleaned, said potential applying member being disposed so as to permit contact with said member to be cleaned on an opposite side of said member to be cleaned from said cleaning member, wherein a position of contact between said potential applying member and said member to be cleaned is upstream and in a vicinity of a position of contact between said cleaning member and said member to be cleaned in a direction of movement of said member to be cleaned.

2. A cleaning device according to claim 1, wherein said cleaning member comprises a web.

3. A cleaning device according to claim 1, wherein a voltage is applied to said potential applying member.

4. A cleaning device comprising:

a flexible member to be cleaned;

cleaning means for cleaning a surface of said member to be cleaned, said cleaning means comprising a cleaning web in contact with said member to be cleaned and a pressure member for pressing said cleaning web on said member to be cleaned, said pressure member being conductive and earthed;

a potential applying member, provided on an opposite side of said member to be cleaned from said cleaning web, for applying a predetermined potential to said member to be cleaned, said potential applying member being provided at substantially the same position as said cleaning web in a direction of movement of said member to be cleaned.

5. A cleaning device according to claim 4, wherein said potential applying member is disposed so as to contact said member to be cleaned.

6. A cleaning device according to claim 5, wherein said pressure member and said potential applying member press said cleaning web and said member to be cleaned therebetween.

7. A cleaning device according to claim 6, wherein said member to be cleaned comprises a belt.

8. A cleaning device comprising:

a flexible member to be cleaned;

cleaning means for cleaning a surface of said member to be cleaned, said cleaning means including a cleaning web in contact with said member to be cleaned and a first pressure roller for pressing said cleaning web on said member to be cleaned; and a second pressure roller for pressing said member to be cleaned on said cleaning web, wherein said first and second pressure rollers press said cleaning web and said member to be cleaned therebetween, and a voltage is applied to at least one of said first and second pressure rollers.

9. A cleaning device according to claim 8, wherein the voltage is applied to said second pressure roller, and said first pressure roller is electrically earthed.

10. An image forming apparatus comprising:

an image bearing member for bearing a toner image;

a flexible recording material holding member for holding and conveying a recording material;

transfer charge means for transferring the toner image borne by said image bearing member to the recording material held by said recording material holding member;

fixing means for fixing the toner image to the recording material after transfer of the toner image to the recording material;

cleaning means for cleaning a surface of said recording material holding member on which a recording material is held, said cleaning means including a cleaning web in contact with said recording material holding member; and a potential applying member, provided on an opposite side of said recording material holding member from said cleaning web, for applying a predetermined potential to said recording material holding member, said potential applying member being provided at substantially the same position as said cleaning web in a direction of movement of said recording material holding member, wherein said apparatus is operable in a mode in which said apparatus transfers and fixes the toner image to a first side of the recording material, and then transfers and fixes another toner image onto a second side of the recording material opposite to the first side.

11. An image forming apparatus according to claim 10, further comprising supply means for supplying the recording material to said recording material holding member so that the first side of the recording material is in contact with said recording material holding member without discharging the recording material outside of said apparatus after the toner image is fixed to the first side of the recording material.

12. An image forming apparatus according to claim 10 or 11, wherein said fixing means comprises an oil coating layer.

13. An image forming apparatus according to claim 12, wherein a surface of said cleaning web in contact with said recording material holding member comprises fibers having a size of 10 μm or less at a rate of 70% or more, an average size of 10 μm or less, and a density of 0.05 to 0.80 g/cm$^3$.

14. An image forming apparatus comprising:

a flexible recording material holding member for holding and conveying a recording material;

image forming means for forming a toner image on a recording material held by said recording material holding member;

cleaning means for cleaning a surface of said recording material holding member on which a recording material is held, said cleaning means including a cleaning member in contact with said recording material holding member; and a potential applying member for applying a predetermined potential to said recording material holding member, said potential applying member being disposed so as to permit contact with said recording material holding member on an opposite side of said recording material holding member from said cleaning member, wherein a position of a contact between said potential applying member and said recording material holding member is upstream and in a vicinity of a position of contact between said cleaning member and said recording material holding member, in a direction of movement of said recording material holding member.

15. An image forming apparatus according to claim 14, wherein said cleaning member comprises a web.

16. An image forming apparatus according to claim 14, wherein a voltage is applied to said potential applying member.

17. An image forming apparatus comprising:

a flexible recording material holding member for holding and conveying a recording material;

image forming means for forming a toner image on a recording material held by said recording material holding member;

cleaning means for cleaning a surface of said recording material holding member on which a recording member is held, said cleaning means including a cleaning web in contact with said recording material holding member and a pressure member for pressing said cleaning web on said recording material holding member, said pressure member being conductive and electrically earthed; and a potential applying member, disposed on an opposite side of said recording material holding member from said cleaning web, for applying a predetermined potential to said recording material holding member, said potential applying member being disposed at substantially a same position as said cleaning web in a direction of movement of said recording material holding member.

18. An image forming apparatus according to claim 17, wherein said image forming means has an image bearing member and transfer charge means for transferring said toner image from said image bearing member to said recording material held by said recording material holding member, and said apparatus further comprises fixing means for fixing said toner image to said recording material.

19. An image forming apparatus according to claim 18, wherein a plurality of toner images successively borne by said image bearing member are successively transferred one over the other to the recording material held by said recording material holding member.

20. An image forming apparatus according to claim 18, wherein said potential applying member is provided so as to contact said recording material holding member.

21. An image forming apparatus according to claim 18 or 20, wherein a voltage is applied to said potential applying member.

22. An image forming apparatus according to claim 21, wherein said predetermined potential has a polarity opposite to a polarity of a potential applied to the side of said recording material holding member on which no recording material is held from said transfer charge means.

23. An image forming apparatus according to claim 20, wherein said pressure member and said potential applying member press said cleaning web and said recording material holding member therebetween.

24. An image forming apparatus according to claim 23, wherein said recording material holding member comprises a belt.

25. An image forming apparatus comprising:

a flexible recording material holding member for holding and conveying a recording material;

image forming means for forming a toner image on a recording material held by said recording material holding member;

cleaning means for cleaning a surface of said recording material holding member on which a recording material is held, said cleaning means including a cleaning web in contact with said recording material holding member and a first pressure roller for pressing said cleaning web on said recording material holding member; and a second pressure roller for pressing said recording material holding member on said cleaning web, wherein said first and second pressure rollers press said cleaning web and second rollers press said cleaning web and said recording material holding member therebetween, and a voltage is applied to at least one of said first and second pressure rollers.

26. An image forming apparatus according to claim 25, wherein the voltage is applied to said second pressure roller, and said first pressure roller is electrically earthed.

27. An image forming apparatus comprising:

a recording material carrying member for carrying a recording material, said recording material carrying member being reciprocating in a direction perpendicularly intersecting a direction of movement of said recording material carrying member;

image forming means for forming an image on the recording material carried by said recording material carrying member; and cleaning member for cleaning said recording material carrying member, said recording material carrying member being reciprocated within a range capable of being cleaned by said cleaning member, in a direction perpendicularly intersecting the direction of movement of said recording material carrying member.

28. An image forming apparatus according to claim 27, further comprising a potential applying member, in contact with said recording material carrying member, for applying a predetermined potential to said recording material carrying member, wherein a width in which said potential applying member applies the potential to said recording material carrying member is within a width of said recording material carrying member, regardless of reciprocation of said recording material carrying member, in the direction perpendicularly intersecting the direction of movement of said recording material carrying member.

29. An image forming apparatus according to claim 28, wherein the width in which said potential applying member applies the potential to said recording material carrying member is wider than the recording material having a maximum size capable of carrying by said recording material carrying member in the direction perpendicularly intersecting the direction of movement of said recording material carrying member.

30. An image forming apparatus according to claim 27, wherein said image forming means comprises an image bearing member for bearing a toner image and a transfer charger for transferring the toner image to the recording material carried by said recording material carrying member.

31. An image forming apparatus according to claim 30, wherein a plurality of toner images are successively transferred to the recording material carried by said recording material carrying member.

32. An image forming apparatus according to claim 27, further comprising a pressing member for pressing said cleaning member on the recording material carrying member, wherein a length of said pressing member is longer than that of said cleaning member, in the direction perpendicularly intersecting the direction of movement of said recording material carrying member.

33. An image forming apparatus according to claim 32, wherein said cleaning member comprises a web.

34. An image forming apparatus according to claim 32, further comprising a potential applying member, in contact with said recording material carrying member, for applying a predetermined potential to said recording material carrying member, wherein a width in which said potential applying member applies the potential to said recording material carrying member is within a width of said recording material carrying member, regardless of reciprocation of said recording material carrying member, in the direction perpendicularly intersecting the direction of movement of said recording material carrying member.

35. An image forming apparatus according to claim 34, wherein said potential applying member and said pressing member press said recording material carrying member and said cleaning member therebetween.

36. An image forming apparatus according to claim 35, wherein a voltage is applied to said potential applying member.

37. An image forming apparatus according to claim 35 or 36, wherein said pressing member is electrically earthed.

38. An image forming apparatus comprising:

a recording material carrying member for carrying recording material, said recording material carrying member being reciprocated in a direction perpendicularly intersecting a direction of movement of said recording material carrying member;

image forming means for forming an image on the recording material carried by said recording material carrying member; and a potential applying member, in contact with said recording material carrying member, for applying a potential to said recording material carrying member, wherein a width in which said potential applying member applies the potential to said recording material carrying member is within a width of said recording material carrying member, regardless of reciprocation of said recording material carrying member, in a direction perpendicularly intersecting the direction of movement of said recording material carrying member.

39. An image forming apparatus according to claim 38, wherein the width in which said potential applying member applies the potential to said recording material carrying member is wider than the recording material having a maximum size capable of carrying by said recording material carrying member, in the direction perpendicularly intersecting the direction of movement of said recording material carrying member.

40. An image forming apparatus according to claim 38, wherein a voltage is applied to said potential applying member.

41. An image forming apparatus according to claim 40, wherein a plurality of the toner images are successively transferred one over the other to the recording material carried by said recording material carrying member.

42. An image forming apparatus according to claim 38, wherein said image forming means comprises an image bearing member for bearing a toner image and a transfer charger for transferring the toner image to the recording material carried by said recording material carrying member.

* * * * *

UNITED STATES PATENT AND TRADEMARK OFFICE

CERTIFICATE OF CORRECTION

PATENT NO. : 5,506,669

DATED : April 9, 1996

INVENTOR(S) : Masahiro INOUE, et al.

It is certified that error appears in the above-indentified patent and that said Letters Patent is hereby corrected as shown below:

Title page;

ITEM [56] - FOREIGN PATENT DOCUMENTS:

Insert: --2-39186 2/1990 Japan--.

COLUMN 6:

Line 61, "of" should read --of a--.

COLUMN 7:

Line 44, "108" should read --$10^8$--.

COLUMN 10:

Line 50, "The" should read --¶The--.

UNITED STATES PATENT AND TRADEMARK OFFICE

CERTIFICATE OF CORRECTION

PATENT NO. : 5,506,669

DATED : April 9, 1996

INVENTOR(S) : Masahiro Inoue, et. al.

It is certified that error appears in the above-indentified patent and that said Letters Patent is hereby corrected as shown below:

Column 11:

Line 15, "earthed;" should read --earthed; and--.

Signed and Sealed this

Twenty-seventh Day of August, 1996

*Attest:*

BRUCE LEHMAN

*Attesting Officer*

*Commissioner of Patents and Trademarks*